US005735415A

United States Patent [19]

Wilson

[11] Patent Number: 5,735,415

[45] Date of Patent: Apr. 7, 1998

[54] CHRISTMAS TREE WITH SHELVING SYSTEM

[75] Inventor: Steven P. Wilson, Lansing, Mich.

[73] Assignee: S. P. Wilson, Inc., Lansing, Mich.

[21] Appl. No.: 677,895

[22] Filed: Jul. 10, 1996

[51] Int. Cl.[6] ..... A47B 43/00

[52] U.S. Cl. ..... 211/187; 248/219.4

[58] Field of Search ..... 211/187, 153, 211/205; D11/118, 130, 130.1; 47/42, 43; 428/18, 19; 248/219.4, 230.8, 218.4, 219.3, 230.1

[56] References Cited

U.S. PATENT DOCUMENTS

| | | | |
|---|---|---|---|
| D. 332,970 | 2/1993 | Myers | D19/88 X |
| 1,577,207 | 3/1926 | Dieperink-Langereis . | |
| 3,019,357 | 1/1962 | Zaffina | D11/118 X |
| 3,164,344 | 1/1965 | Whyte | D11/118 X |
| 3,219,512 | 11/1965 | Kovacevic | D11/118 X |
| 3,240,863 | 3/1966 | Brede | 248/219.4 |
| 3,599,360 | 8/1971 | Lappo . | |
| 3,674,612 | 7/1972 | Gehl, Jr. . | |
| 3,766,376 | 10/1973 | Sadacca et al. | D11/118 X |
| 4,291,075 | 9/1981 | Puleo | 211/205 X |
| 4,345,526 | 8/1982 | Streit | 211/205 X |
| 4,396,652 | 8/1983 | Koehler | 211/205 X |
| 4,399,172 | 8/1983 | De Cosmo | 211/205 X |
| 4,409,907 | 10/1983 | Norton | 248/230.8 |
| 4,496,615 | 1/1985 | Huang | 211/205 X |
| 4,674,597 | 6/1987 | Humphrey | 248/230.8 |
| 4,730,803 | 3/1988 | Hillstrom | 248/219.4 |
| 4,789,570 | 12/1988 | Maddock | 211/205 X |
| 4,923,260 | 5/1990 | Poulsen | 211/153 X |
| 5,071,098 | 12/1991 | Aldridge | 248/219.4 |
| 5,085,901 | 2/1992 | Johnson et al. . | |
| 5,117,779 | 6/1992 | Karow | 248/230.8 |
| 5,150,874 | 9/1992 | Spiegel et al. | 211/205 X |
| 5,263,675 | 11/1993 | Roberts | 248/219.4 |
| 5,423,281 | 6/1995 | Crookham | 248/218.4 |
| 5,601,263 | 2/1997 | Thayer | 248/219.4 |

*Primary Examiner*—Ramon O. Ramirez
*Assistant Examiner*—Gwendolyn W. Baxter
*Attorney, Agent, or Firm*—Young & Basile, P.C.

[57] ABSTRACT

A Christmas tree shelf structure for use with either natural or artificial trees consisting of radially extending shelf supports which are removably mounted upon the tree column or trunk. Three different embodiments of shelf bracket support are shown, and the brackets permit a display shelf to be located within the branches of a Christmas tree to permit the support of tree decorations not otherwise usable with Christmas trees.

1 Claim, 2 Drawing Sheets

FIG. 1
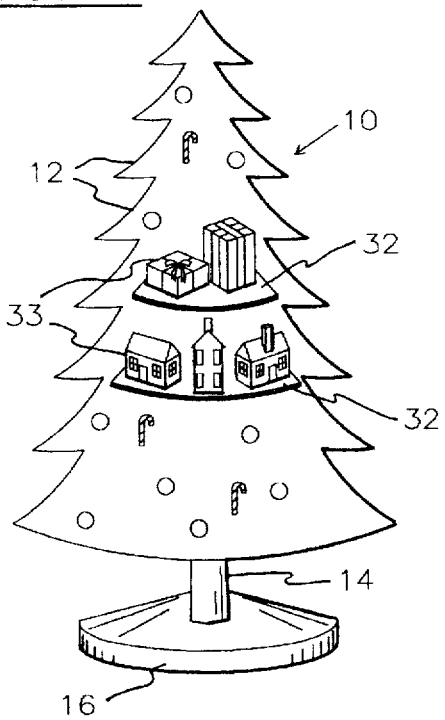
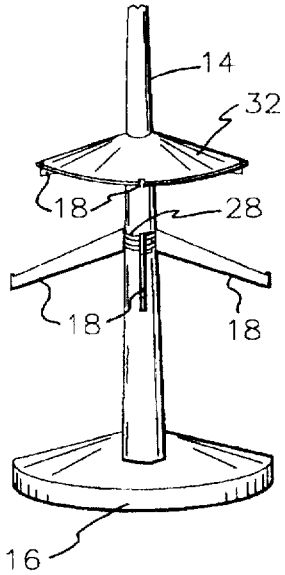
FIG. 2
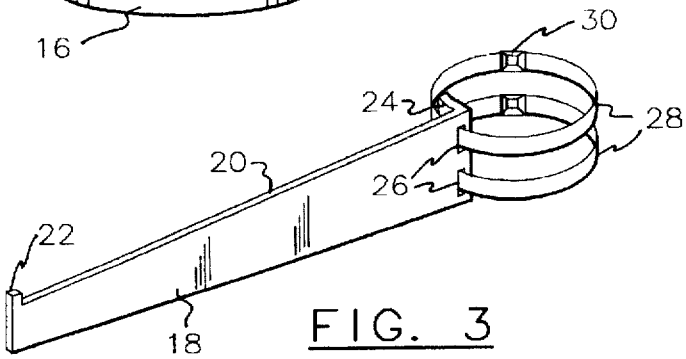
FIG. 3
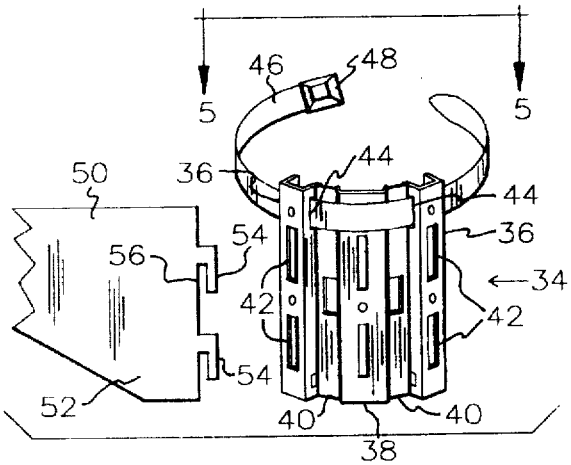
FIG. 4
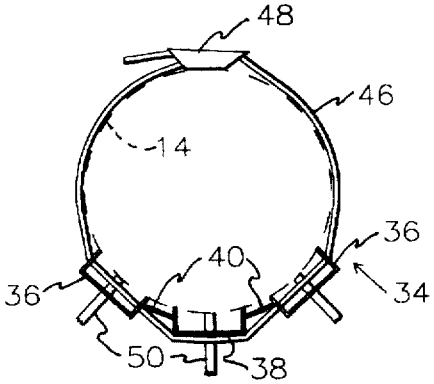
FIG. 5

CHRISTMAS TREE WITH SHELVING SYSTEM

BACKGROUND OF THE INVENTION

1. Field of the Invention

The invention pertains to shelving systems for either natural or artificial Christmas trees.

2. Description of the Related Art

The use of Christmas trees to celebrate the Christmas holiday is widely practiced, as is the hanging of decorations and lights upon the tree branches. In more recent times, artificial trees have become very popular, and such artificial trees are made to appear as closely as possible to natural trees and are used in the same manner wherein the decorations are attached to the tree branches.

Display stands in the form of Christmas trees wherein shelves are mounted upon a central column are known as shown in U.S. Pat. Nos. 1,577,207 and 3,674,612. However, such devices, while in the general shape of a Christmas tree, do not employ needled branches, and for most people would not be a proper substitute for a more traditional Christmas tree.

It is known to incorporate a shelf into an artificial Christmas tree for display purposes as shown in U.S. Pat. No. 5,085,901. In this patent, a shelf is disclosed at mid-height whereby houses, candy, packages and the like may be mounted on the shelf and are readily visible. The practice of this invention requires a special construction of artificial tree, and as the tree configuration immediately above the shelf must be devoid of branches, the concept of this patent has not been popular in that too great a modification of a conventional Christmas tree is required.

OBJECTS OF THE INVENTION

It is an object of the invention to provide a shelf system for Christmas trees, either natural or artificial, which may be retrofitted to existing trees.

Another object of the invention is to provide a shelf system for Christmas trees which may be readily attached to the tree column or trunk by users of ordinary skill, and wherein the shelf system is strong enough to support displays of conventional weight.

A further object of the invention is to provide a shelf system for Christmas trees which permits larger objects than usual to be displayed on a Christmas tree, and wherein the shelf system is unobtrusive and integrated into the tree appearance.

SUMMARY OF THE INVENTION

The inventive concepts can be utilized with either natural or artificial Christmas trees, and the shelving system of the invention is easily fitted to natural or artificial trees, or can be permanently mounted upon artificial trees.

Basically, the invention employs a system for attaching shelf supporting brackets to the tree column or trunk. Preferably, the brackets are removably mounted to the column or trunk by straps or a band wherein various sizes of columns and trunks may be readily accommodated. In one embodiment, the elongated shelf brackets include an inner end having an anchor portion adapted to directly engage the column or tree trunk, and the tightening of straps passing through openings in the bracket inner end will hold the bracket against its support. A plurality of brackets are mounted on the straps such that all the brackets will be at the same elevation, and a partial circular shelf is supported upon the brackets.

Of course, it is necessary that sufficient tree column or trunk space be available to properly mount the brackets thereon, and it may be necessary to trim some branches at the trunk of natural trees. Preferably, a minimum of branch trimming takes places so that the shelf will be somewhat hidden from view by the tree branches, and decorations, such as toys, small houses, packages, ornaments, and the like, may be placed upon the shelf as to be readily visible while the shelf itself and its brackets are barely discernible, and are hidden by the tree branches and needles.

In another embodiment of the invention, a bracket supporting anchor member is connected to the tree column or trunk and held thereon by straps. The anchor includes notches, and shelf support brackets having hooks defined at their inner ends are mounted to the anchor by receiving the hooks within the anchor openings. In this manner, the brackets may be readily attached or removed from the anchor, and with an artificial tree, the anchor can be permanently attached to the tree column and the shelf brackets removed during storage.

In an additional embodiment of the invention, the shelf brackets are manufactured in homogeneous pairs wherein the brackets are disposed at 90° to each other interconnected by an arcuate concave transition portion adapted to engage the tree trunk or central support. This construction permits the brackets to be bolted together firmly squeezing the tree trunk or center pole for achieving a mechanical connection thereto. The shelf is supportable upon the upper edge of the brackets.

BRIEF DESCRIPTION OF THE DRAWINGS

The aforementioned objects and advantages of the invention will be appreciated from the following description and accompanying drawings wherein:

FIG. 1 is an perspective view of a Christmas tree utilizing the shelving system of the invention, FIG. 2 is an perspective view of a Christmas tree utilizing the invention, the tree branches not being shown for purpose of illustration, and the lower shelf is not illustrated for better viewing of the distribution of the shelf brackets, FIG. 3 is an enlarged perspective view of the shelf brackets utilized in the embodiment of FIG. 2, FIG. 4 is a perspective view of another embodiment for holding the shelf brackets upon the tree column or trunk, the inner end of a shelf bracket having hooks being shown in an exploded relationship prior to the bracket being mounted upon the anchor, FIG. 5 is a plan sectional view of the anchor as taken in the direction of Section 5—5 of FIG. 4.

DESCRIPTION OF THE PREFERRED EMBODIMENTS

Figure 6:
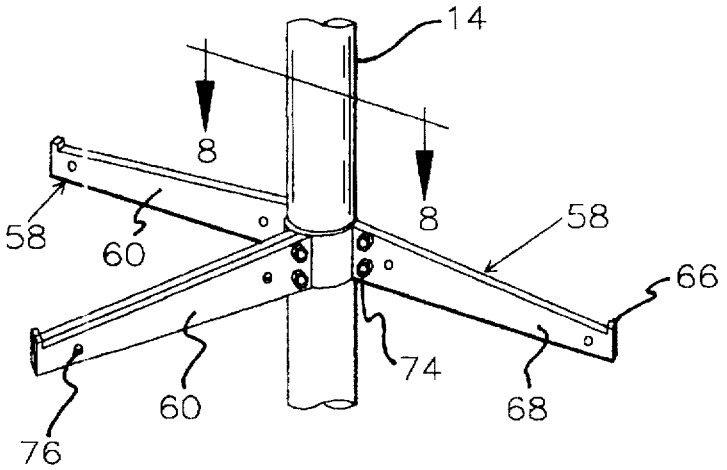
FIG. 6 is an perspective detail view showing another embodiment of shelf bracket wherein each bracket unit includes a pair of shelf supports related at 90° to each other.

The overall appearance of a Christmas tree utilizing the shelving system of the invention will be appreciated from FIG. 1 wherein a tree 10 is schematically illustrated. The illustrated tree may either be natural, or artificial, and includes a plurality of branches 12 radially extending from a trunk or column 14 mounted upon base 16. In the illustrated Christmas tree embodiment, two shelves are shown as mounted on the tree, as later described.

The shelf brackets 18, FIGS. 2 and 3, which may be three or four in number, each include a flat upper edge 20 upon which the shelf is supported. An upwardly extending stop 22 projects above the edge 20 for purposes of retaining the shelf. Each shelf bracket 18 includes a base 24 disposed at substantially right angles to the length of the associated bracket, and openings 26 are formed in the inner end of the bracket for receiving straps 28. The openings 26 may be formed in the longitudinal length of the bracket, as shown, or may be formed at the intersection of the primary bracket portion and the base 24. The straps 28 are each provided with an adjustment buckle whereby the length of the strap may be variably adjusted, and the buckles 30 may take any conventional form. For instance, if the straps 28 are formed of a fabric material, hook and loop buckles of the VELCRO®type may be employed, or if the straps 28 are formed of webbing or metal, various types of cam type buckles may be employed for maintaining the straps in a tightened condition.

The brackets 18 are mounted upon the tree trunk or column 14 by positioning the number of brackets desired about the trunk, and will usually be located at less than 90° to each other as the shelf which is supported by the brackets is usually less than 180° in circumferential form. Upon the brackets 18 being positioned upon the trunk 14 as desired, the straps 28 are tensioned such that the bracket bases 24 will be brought into firm engagement with the trunk and the brackets will radially extend from the trunk capable of supporting the shelf 32, FIG. 2, which is placed upon the bracket upper edges 20 inside of the stops 22. The shelf 32 may be formed of plastic, metal, paperboard, or the like, and is preferably of a color which matches that of the tree branches 12 so as to be inconspicuous. In FIG. 2, two shelf systems are illustrated, the upper shelf system being completely assembled wherein the shelf 32 is mounted upon the brackets 18. In the lower shelf system, the shelf has not yet been placed upon the brackets in order to illustrate the orientation of the brackets on the trunk 14.

It will usually be preferable to remove or trim the branches 12 immediately above the shelf or shelves 32 in order to provide sufficient room for the decorations 33 which will be mounted upon the shelves. Such decorations would typically consist of packages, small toys, and the like, which normally cannot be supported upon a Christmas tree.

By the trimming of the branches 12, it is possible to locate the brackets 18 within the tree branches so as to hide the brackets from view, and by judicious pruning of the branches, the space above the shelves can be maintained at a minimum so that the support structure for the decorative items 33 will not be readily apparent. Accordingly, the practice of the invention permits a Christmas tree to be decorated by items 33 of such bulk and configuration as not to be normally displayed on a tree.

When the shelving system of the invention is used with a natural tree, the shelving system may be readily removed therefrom prior to tree discard by unbuckling the straps 28 and removing the brackets 18. The shelving system may then be used year after year. With an artificial tree, it may or may not be desired to remove the shelf system for storage purposes, the option lying with the tree owner.

FIGS. 4 and 5 illustrate another embodiment of a shelving system utilizing the concepts of the invention. The embodiment of FIGS. 4 and 5 will provide a higher strength than the previously described structure permitting the shelf to support a greater weight of decorations.

As will be appreciated from FIGS. 4 and 5, a sheet metal anchor 34 is formed of a generally arcuate configuration so as to be disposed about a significant circumferential portion of the tree trunk or column as represented in dotted lines in FIG. 5. The anchor 34 consists of outer channel sections 36 and an inner channel section 38, and connecting sections 40 are interposed between the sections 36 and 38. The sections 36, 38 and 40, all being of a channel configuration, include inwardly extending narrow edges capable of imbedding into the tree trunk or column to augment attachment of the anchor 34 thereto.

Rectangular openings 42 are formed in each of the sections 36 and 38 for receiving the bracket hooks as later described. Also, the anchor sections 36 are provided with strap receiving openings 44 through which the strap 46 is threaded, FIG. 4. The strap 46 may be formed of a thermoplastic material, or a fabric webbing, and includes a buckle 48 for adjustably positioning the circumference of the strap when in use.

The shelf bracket 50, only partially illustrated in FIG. 4, is of a general configuration similar to the shelf bracket 18 of the previously described embodiment. However, the bracket inner end 52 is provided with hooks 54 adapted to be received within the anchor openings 42, and the brackets include lock surfaces 56 disposed adjacent the hooks 54 wherein the insertion of the hooks in the openings 42 and the movement of the hooks downwardly will very firmly lock the brackets 50 to the anchor 34. A shelf, not shown, may then be supported upon the brackets 50 in the previously disclosed manner, and the embodiment of FIGS. 4 and 5 will firmly support a shelf and the weight thereof. Due to the vertical length of the anchor 34, it is only necessary to use one strap 46, and this embodiment of the shelving system inventive concept is capable of supporting a display shelf of considerable weight.

Figure 7:
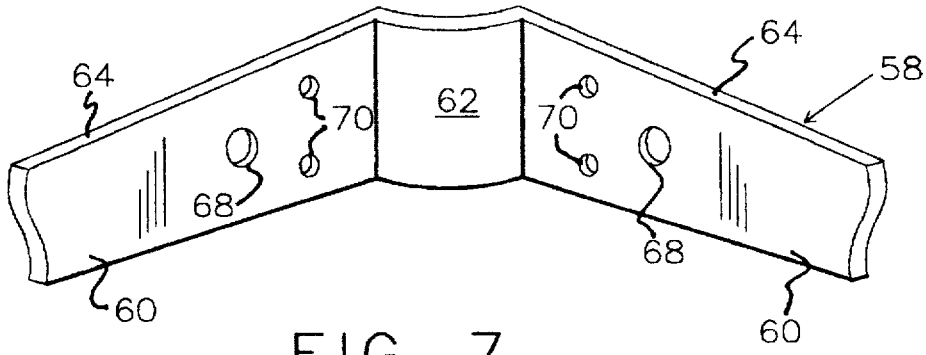
FIG. 7 is an enlarged detail perspective view of the central region of the embodiment of FIG. 6.
Figure 8:
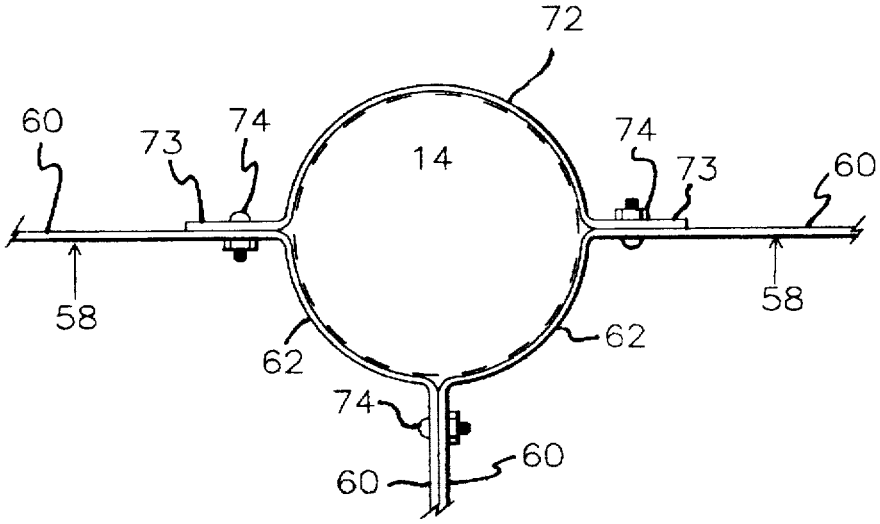
FIG. 8 is a plan sectional view as taken along Section 8—8 of FIG. 6.

A third embodiment of shelf bracket construction is shown in FIGS. 6–8. In this embodiment, each bracket generally indicated at 58 includes a pair of arms 60 interconnected at their inner ends by a concave transition portion 62. The arms 60 are disposed at 90° to each other and each includes an upper edge 64 upon which the shelf, not shown, is supported. Upwardly extending tabs or end stops 66 are defined at the outer end of each arm 60.

Each of the arms 60 includes a hole 68, and a pair of smaller holes 70 adjacent the arms' inner surface. These holes selectively cooperate with bolts as later described.

An arcuate metal band 72 is disposed about the tree trunk portions not engaged by the bracket transition portions 62, and the band 72 includes ears 73 having holes therein whereby the bolts 74 extend through the ear holes and arm holes 68 or 70, as desired.

As best appreciated from FIG. 8, if a shelf supporting bracket having three points of support disposed at 90° to each other is desired, two brackets 58 are assembled as shown in FIG. 8. The two transition portions 62 circumscribe 180° of the tree trunk 14, while the band 72 subscribes the other 180°. The arms 62 of the two brackets 58 which are contiguous to each other are held together by a bolt 74, and if desired, bolts may extend through the outer holes 76 for maintaining the contiguous arms 60 together.

By having bands 72 of various length, or by spacing holes in the ears 73, it is possible to utilize the band 72 to tightly encompass and grip the tree trunk 14 firmly attaching the brackets 58 thereto.

If it is desired that four shelf supporting arms be attached to the trunk 14, two additional brackets 58 may be assembled to the two brackets 58 shown in FIG. 8, and the band 72 is then not employed. In such instance, contiguous arms 60 will exist at each of the quadrant support arm assemblies and the embodiment of FIGS. 6–8 has the versatility to be used in pairs, or four brackets may be employed as described above.

It is also appreciated that it would be possible to use the inventive concepts of the invention by forming slots in the tree trunk or pole 14 wherein shelf brackets were inserted into the slots for supporting a shelf. The use of such slots would not permit the shelf to be vertically positioned with the versatility possible with the disclosed embodiments, but such a construction can be economically achieved.

It is appreciated that various modifications to the inventive concepts may be apparent to those skilled in the art without departing from the spirit and scope of the invention.

I claim:

1. A Christmas tree having shelf structure incorporated therein comprising a vertical column, a plurality of branches extending from said column, a pair of brackets mounted on said column at a common vertical position radially extending in three radial directions from said column in a substantially common horizontal plane, each of said brackets having a pair of arms angularly disposed with respect to each other and each arm having an inner end, a concave transition portion interconnecting said bracket's arms' inner ends adapted to engage said column, a band encircling a portion of said column including ears adapted to engage said bracket arms' inner ends, fasteners interposed between said band ears and said arms' inner ends and contiguous bracket arms, such that the band and brackets firmly squeeze the column to achieve a mechanical connection thereto, and a single shelf simultaneously supported upon said bracket's arms.

* * * * *